US005191382A

United States Patent [19]

Okamura et al.

[11] Patent Number: 5,191,382

[45] Date of Patent: Mar. 2, 1993

[54] IMAGE FORMING SYSTEM

[75] Inventors: Shigeru Okamura, Kawasaki; Koichi Miyamoto, Yokohama; Yutaka Kikuchi; Naoki Asano, both of Kawasaki; Hideo Saito; Hitoshi Ishihama, both of Tokyo, all of Japan

[73] Assignee: Canon Kabushiki Kaisha, Tokyo, Japan

[21] Appl. No.: 871,347

[22] Filed: Apr. 21, 1992

[30] Foreign Application Priority Data

Apr. 22, 1991 [JP] Japan ..... 3-90743
Apr. 22, 1991 [JP] Japan ..... 3-90753

[51] Int. Cl.[5] ..... G03G 15/00
[52] U.S. Cl. ..... 355/309; 271/9
[58] Field of Search ..... 355/308, 309, 311; 271/9, 144, 162, 164, 171

[56] References Cited

U.S. PATENT DOCUMENTS

| | | | |
|---|---|---|---|
| 4,108,427 | 8/1978 | Komori et al. | 271/9 |
| 4,816,864 | 3/1989 | Tanaka et al. | 355/308 |
| 5,085,419 | 2/1992 | Bell | 271/9 |
| 5,102,112 | 4/1992 | Takahashi | 271/164 X |
| 5,121,169 | 6/1992 | Kawabata | 355/311 |
| 5,122,841 | 6/1992 | Sasaki | 355/308 X |

FOREIGN PATENT DOCUMENTS

| | | |
|---|---|---|
| 60-8954 | 1/1985 | Japan . |
| 60-59264 | 4/1985 | Japan . |

*Primary Examiner*—Joan H. Pendegrass
*Assistant Examiner*—Sandra L. Brasé
*Attorney, Agent, or Firm*—Fitzpatrick, Cella, Harper & Scinto

[57] ABSTRACT

The present invention provides an image forming system including a containing portion capable of containing a first sheet supporting means for stacking and supporting sheets, extender means for expanding a containing space of the containing portion in a height direction so that a second sheet supporting means having sheet containing ability greater than that of the first sheet supporting means can be contained in the expanded containing space, sheet supply means for feeding out the sheet from the first or second sheet supporting means contained in the containing portion; and image forming means for forming an image on the sheet fed by the sheet supply means. Wherein the extender means includes a plurality of extender members adapted to be arranged at both lateral sides of the sheet supporting means to increase the height of the containing portion, and connecting means for connecting the plurality of extender members.

21 Claims, 18 Drawing Sheets

IMAGE FORMING SYSTEM

BACKGROUND OF THE INVENTION

1. Field of the Invention

The present invention relates to an image forming system such as a recording apparatus, copying machine, or the like. In particular, it relates to an image forming system wherein cassettes having different sizes can be replaceable.

2. Related Background Art

In order to increase a recording sheet containing amount in conventional recording apparatuses, as shown in FIG. 21, an additional sheet supply means c is provided at a bottom of a body frame a of a recording system, and an additional sheet supply cassette b is mounted within the recording system below the additional sheet supply means. Alternatively, as shown in FIG. 22, an additional sheet supply unit f having a sheet supply means (not shown) and to which a sheet supply cassette e is attached, can be mounted on a front side of a body frame d of a recording system.

In FIGS. 21 and 22, the letters g, h denote image forming cartridges; and i, j denote optical systems for scanning laser beams emitted in response to external signals by respective polygonal mirrors and for illuminating respective photosensitive drums in the cartridges g, h with the scanned laser beams, respectively. Further, images formed on recording sheets supplied from the standing or permanent sheet supply cassettes and from the additional sheet supply cassettes b, e are fixed by fixing devices k, 1, respectively. The recording sheets to which the images were permanently fixed are ejected onto an upper ejection tray m (FIG. 21) and a rear ejection tray n, FIGS. 22 respectively.

However, in increasing the recording sheet containing amount in the above-mentioned conventional manners, in addition to the provisions of the additional sheet supply cassette b or e, it is necessary to further provide a separating and supplying means for separating and supplying the recording sheets in the additional cassette. Additionally, a motor for driving such separating and supplying means, and a clutch means for connecting/disconnecting the output of the motor are required, and electric control parts and wirings for such motor and clutch are also required. Therefore, conventionally, the user had the great expense for increasing the recording sheet containing amount, in addition to the expense for preparing accessories for the recording apparatus.

To avoid this, a recording apparatus wherein a sheet supply cassette can be attached to legs of a body frame of the apparatus and the sheet supply cassette can be replaced by another sheet supply cassette having different sheet containing ability by changing the legs has been proposed, as disclosed in the Japanese Utility Model Laid-Open No. 60-8954. More particularly, in this recording apparatus, as shown in FIGS. 23A and 23B, a plurality of kinds of leg members, $T_1$, $T_2$ are prepared for support legs of a body frame a of the apparatus, and the leg members $T_1$, $T_2$ have guides for mounting sheet supply cassettes $b_1$, $b_2$ corresponding to the heights of the leg members $T_1$, $T_2$, respectively. When the normal sheet supply cassette $b_1$ is used, the leg members $T_1$ are coupled to the body frame a (as shown in FIG. 23A), and when the larger sheet capacitive cassette $b_2$ is used, the leg members $T_2$ are coupled to the body frame a (as shown in FIG. 23B). In this way, the sheet s cassettes having different sheet containing abilities can be mounted on the recording apparatus.

Further, a recording apparatus wherein the heights of leg members for supporting a body frame of the apparatus are adjustable so that sheet supply cassettes having different sheet containing abilities can be mounted on the bottom of the apparatus has also been proposed, as disclosed in the Japanese Utility Model Laid-Open No. 60-59264.

However, with these arrangements, it was feared that the leg members were distorted or bent at the coupling point to the body frame by the weight of the cassette. If the leg members are distorted or bent, the contacting pressure (sheet supplying pressure) between the sheet supply means and the sheets in the cassette will be changed, thus causing the poor sheet to feed easily. To avoid this, the coupling strength between the leg members and the body frame must be increased and the rigidity of the leg member itself must be increased, which results in the increase in the weight and cost of the apparatus and/or makes the apparatus complicated.

SUMMARY OF THE INVENTION

The present invention aims to eliminate the above-mentioned conventional drawbacks, and an object of the present invention is to provide an image forming system which has a simple construction in which sheet supply cassettes having different sheet containing abilities can selectively be mounted thereon.

In order to achieve the above object, the present invention provides an image forming system comprising a containing portion capable of containing a first sheet supporting means for stacking and supporting sheets. Also, extender means for expanding or widening a containing space of the containing portion in a high direction so that a second sheet supporting means having sheet stacking ability greater than that of the first sheet supporting means can be contained in the expanded containing space, and a sheet supply means for feeding out the sheet from the first or second sheet supporting means containing in the containing portion, and wherein the extender means comprises a plurality of extender members adapted to be arranged at both lateral sides of the sheet supporting means to increase the height of the containing portion, and a connecting means for connecting the plurality of extender members to each other.

The extender means may be removably provided on the containing portion or may be connected to the containing portion in a foldable fashion. Preferably, the extender means comprises auxiliary leg members and a bottom plate for connecting the auxiliary leg members. The bottom plate may be provided with projections for supporting the second sheet supporting means having the larger sheet stacking ability from below to prevent the deformation of the second sheet supporting means.

Further, a guide means may be provided in the containing portion so that the first and second sheet supporting means can be removably or slidably supported thereon.

According to the present invention, by using the extender means, it is possible to selectively use the sheet supporting means having different sheet stacking ability at operator's need. Further, since the extender members of the extender means for increasing the height of the containing portion are connected by the connecting means, the whole rigidity of the extender means is increased, thus preventing the tilt and distortion of the extender members as in the conventional cases, and providing the reliable and stable sheet supply.

BRIEF DESCRIPTION OF THE DRAWINGS

FIG. 8 is a view showing a condition that a cassette extender is mounted on;

DETAILED DESCRIPTION OF THE PREFERRED EMBODIMENTS

The present invention will now be explained in connection with embodiments thereof with reference to the accompanying drawings.

Figure 1:
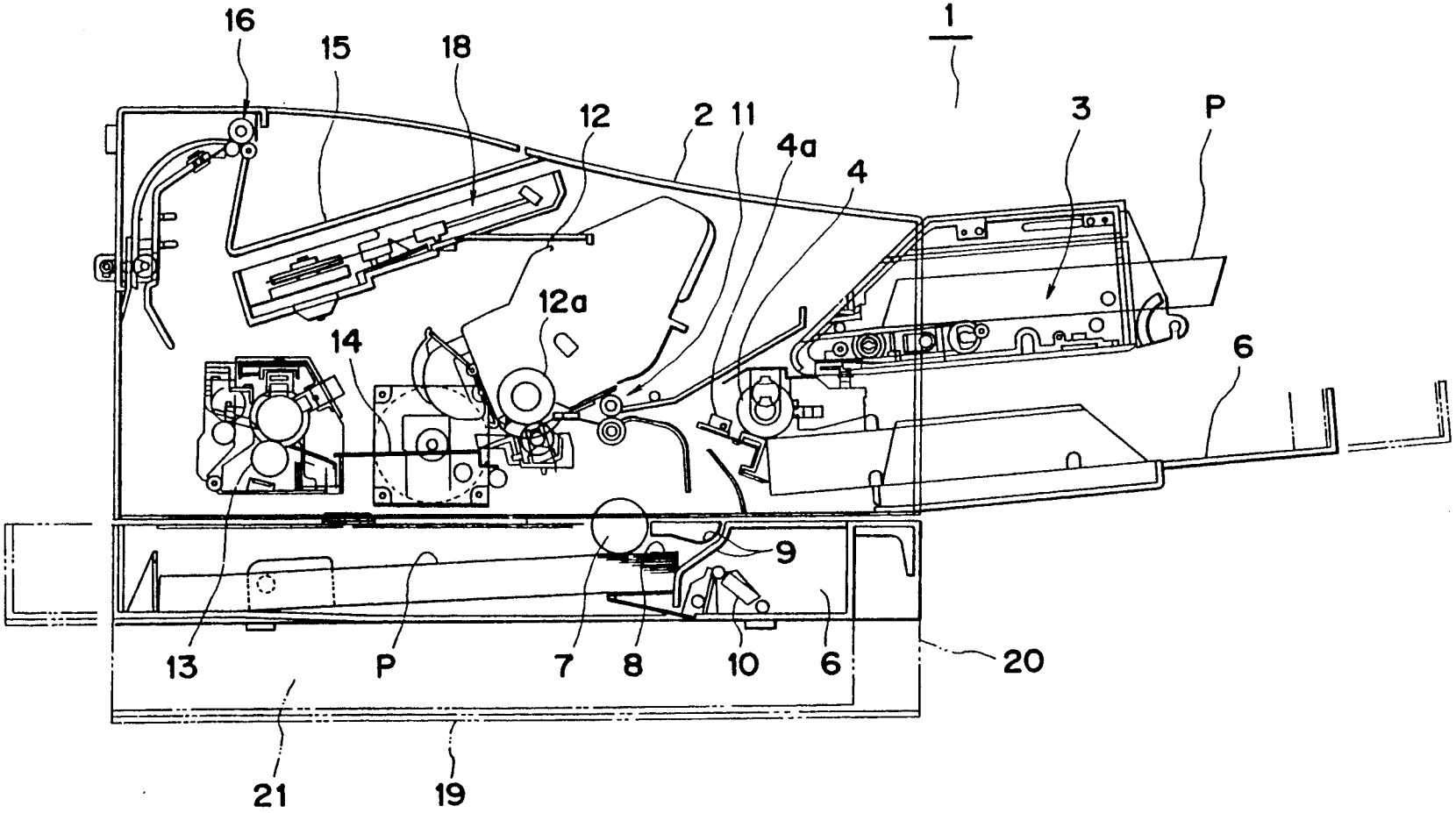
FIG. 1 is an elevational sectional view of an image forming system according to a first embodiment of the present invention.

Explaining a first embodiment of the present invention with reference to FIG. 1, a laser beam printer 1 has a body frame 2 on an upper front side of which a recording sheet supply cassette 3 is removably mounted. Recording sheets P stacked in the cassette can be fed out of the cassette from a lowermost sheet by a sheet feed belt. Further, below the sheet supply cassette 3, another sheet supply cassette 5 is removably mounted on the body frame 2 in such a manner that the cassette 5 cooperates with a sheet supply roller 4 in the body frame 2.

Further, an additional sheet supply cassette 6 can be inserted between leg members 17*a*, 17*b* (FIG. 2) formed on a bottom of the body frame 2. When the cassette 6 is inserted, the recording sheets P stacked in the cassette can be fed out by a sheet supply roller 7 arranged in the body frame 2. Further, separating pawls or claws 8, sheet guides 9 and an push-up intermediate plate 10 are provided on or in the cassette 6.

Convey guides corresponding to the sheet supply cassettes 3, 5, 6 extend toward a pair of regist rollers 11. An image forming cartridge 12 is mounted within the body frame 2 at a central portion thereof, which cartridge is provided at its lower portion with a photosensitive drum 12*a*. A fixing device 13 is disposed rearwardly of the cartridge. A belt-shaped convey portion 14 is disposed between the fixing device 13 and the photosensitive drum 12*a*, and a sheet feeding path extends upwardly from the fixing device 13 to reach a pair of ejector rollers 16 which are disposed of at a rear opening of an ejection tray 15 formed on an upper surface of the body frame 2, and are adapted to eject the recording sheet on the ejection tray 15.

Further, below the ejection tray 15, an optical system 18 for emitting a laser beam in response to an external signal and for illuminating the photosensitive drum 12*a* with the laser beam scanned by a polygonal mirror is disposed within the body frame 2.

Figure 2:
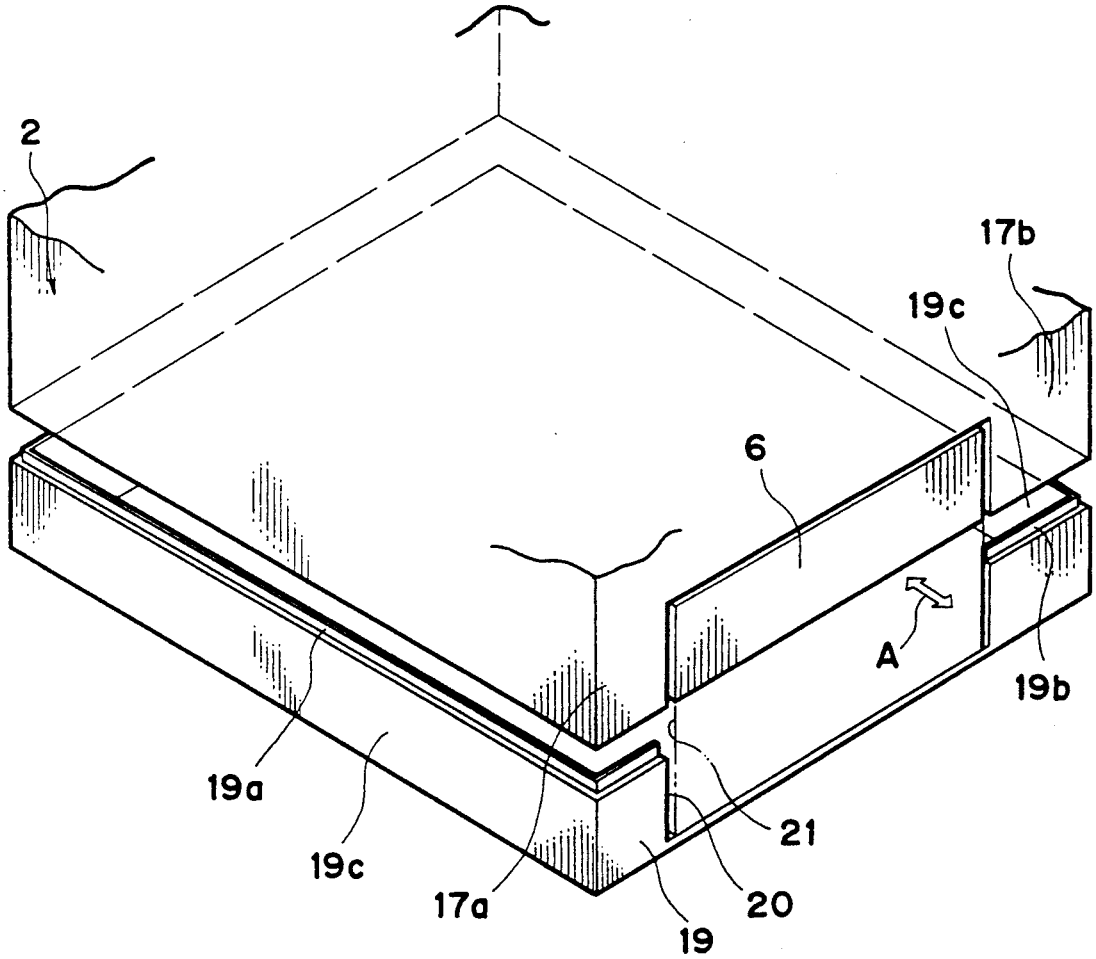
FIG. 2 is a perspective view of a part of the image forming system of FIG. 1.

Further, as shown in FIG. 2, engagement grooves (not seen in FIG. 2) are formed on the bottoms of the leg members 17*a*, 17*b*, and projecting portions 19*a*, 19*b* of side plates (auxiliary leg members) 19*c* of a cassette extender 19 are adapted to be fitted into the corresponding engagement grooves. An opening 20 for inserting the cassette is formed on a rear side wall of the cassette extender 19.

Next, an operation of the illustrated embodiment will be explained.

The recording sheet from the sheet supply cassette 3 is fed to the regist rollers 11 by means of a sheet supply roller provided on the cassette itself. On the other hand, the recording sheet P from the cassette 5 is supplied by the sheet supply roller 4, and is separated by separating claws 4*a*, and is fed to the regist rollers 11.

The recording sheets P stacked in the sheet supply cassette 6 are supplied by the sheet supply roller 7 and are separated one by one by the separating claws 8. The separated sheet is guided by the sheet guides 9 of the cassette 6 and the guides in the body frame 2, to reach the regist rollers 11. After the posture of the recording sheet is corrected by the regist rollers 11, the recording sheet is fed to the photosensitive drum 12*a* in registration with an image formed on the photosensitive drum, and the image is transferred from the drum 12*a* to the moving recording sheet P. Then, the recording sheet is sent to the fixing device 13, where the image is permanently fixed to the recording sheet P. Thereafter, the recording sheet P is sent, through the sheet feeding path in the body frame 2, to the ejector rollers 16 by which the recording sheet is ejected onto the ejection tray 15.

On the other hand, a latent image is formed on a surface of the photosensitive drum 12*a* by illuminating the drum with the laser beam from the optical system 18. The latent image is then developed by a developing device in the cartridge 12 to form a toner image to be transferred to the recording sheet P.

Further explaining the sheet supply cassette 6, it is assumed that the cassette 6 is desired to be replaced by a sheet supply cassette 21 having a greater height and containing a greater number of recording sheets P.

To achieve such replacement, the cassette extender 19 is attached to the leg members 17*a*, 17*b* of the body frame 2, via the projecting portions 19*a*, 19*b*, so that the body frame 2 is elevated. Then, the sheet supply cassette 21 is inserted through the opening 20 in a direction shown by the arrow A so that the recording sheet in the cassette 21 can be fed by the sheet supply roller 7 in the body frame 2.

As mentioned above, by adding the cassette extender to the body frame of the printer to permit the insertion of the cassette 21, it is possible to increase a sheet supply amount without providing an additional sheet supply roller, a driving source therefor and a driving mechanism such as a clutch and, the like, thus reducing the number of sheet replenishing operations and the operator's labor.

Figure 3:
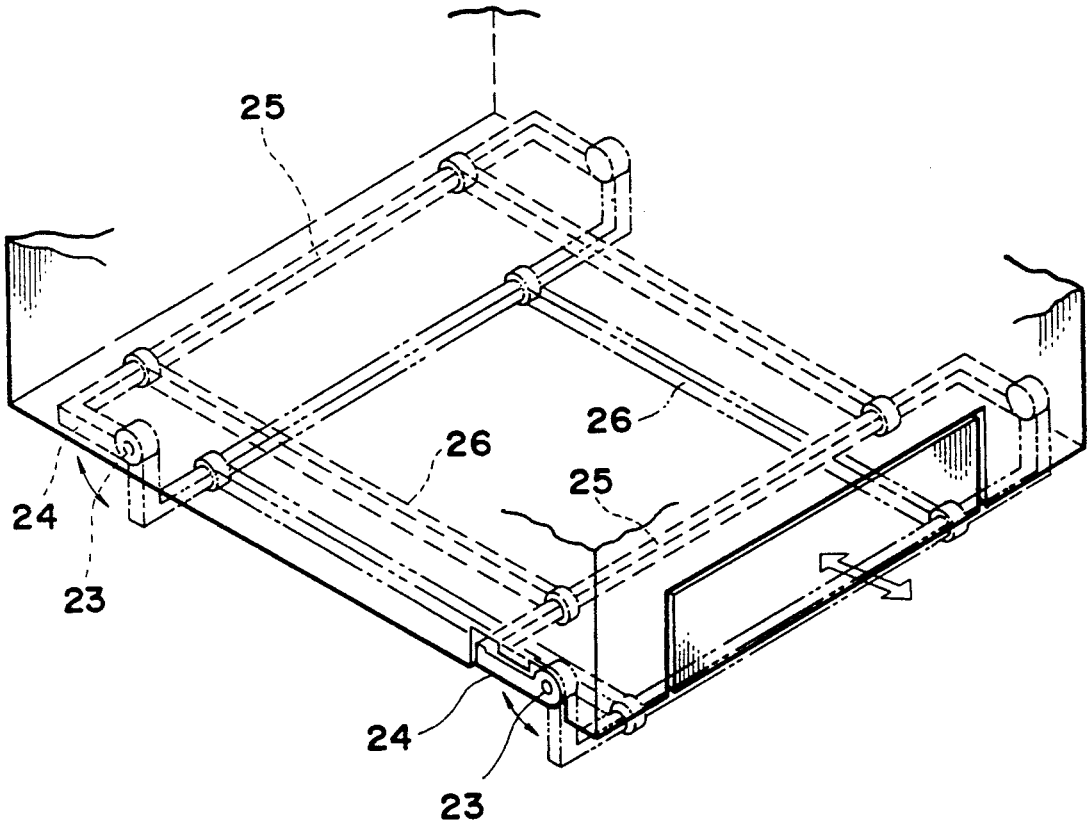
FIG. 3 is a perspective view of a second embodiment of the present invention, showing a main portion thereof alone.

Next, a second embodiment of the present invention will be explained with reference to FIG. 3.

In this second embodiment, front support legs 24 which are integrally connected at their one ends to a front horizontal bar 25 are pivotally mounted, at the other ends, on horizontal shafts 23. Similarly, rear support legs 24 which are integrally connected at their one ends to a rear horizontal bar 25 are pivotally mounted, at the other ends, on horizontal shafts 23. The front and rear horizontal bars 25 are pivotally interconnected via two connecting rods 26 so front and rear support legs 24 can be rotated into position simultaneously. Incidentally, the support legs can be snappingly stopped at their vertical positions and can be released by a release lever (not shown) to return to their horizontal positions.

In this way, when the front or rear support legs 24 are cocked to the vertical position, the rear or front support legs 24 will also be cocked to the vertical position automatically.

Next, examples that have been adopted in the above-mentioned first embodiment of the present invention will be described with reference to FIGS. 4 and 5.

Figure 4:
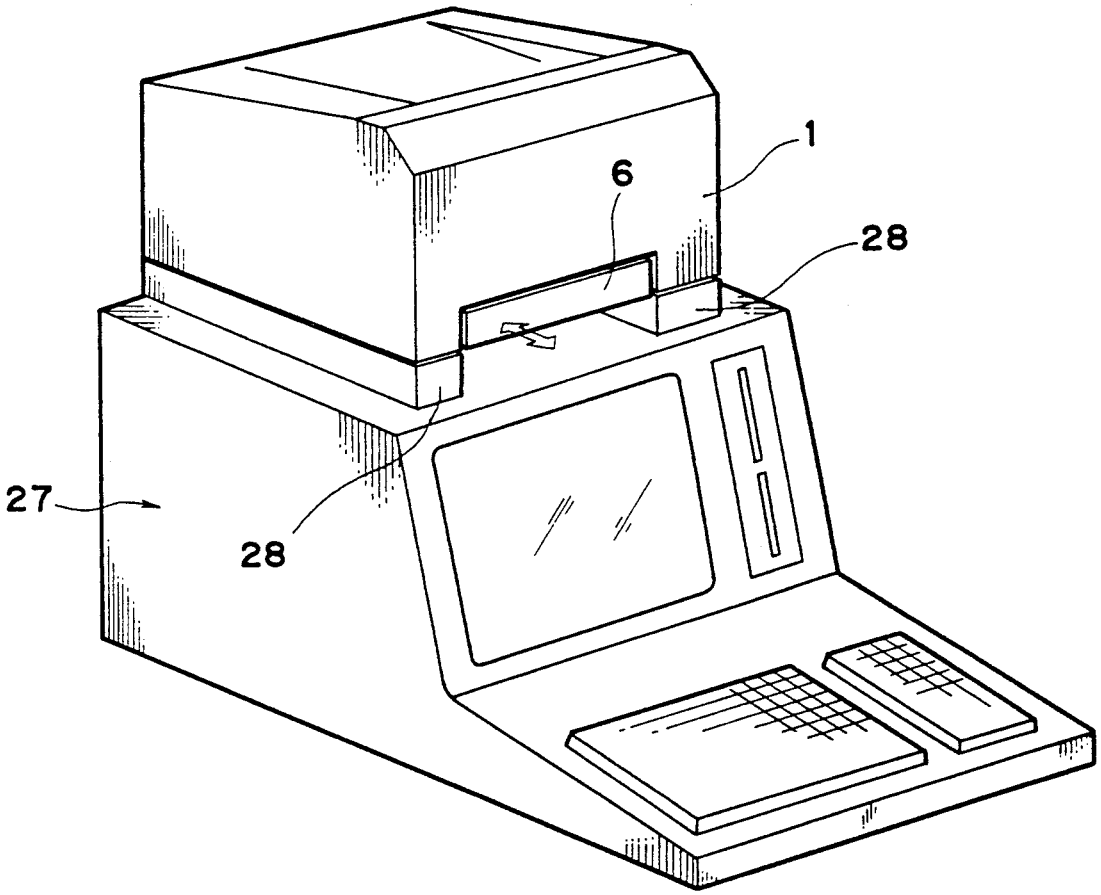
FIG. 4 is a perspective view showing an example of how the first embodiment is applied.

In FIG. 4, the cassette extender and the leg members are not provided on the printer 1, but a pedestal 28 is previously formed on a host computer 27 for controlling the printer 1, and the printer 1 is installed on the pedestal 28.

Incidentally, the pedestal 28 may be housed into the host computer 27 or may be extended and retracted with respect to the host computer.

Figure 5:
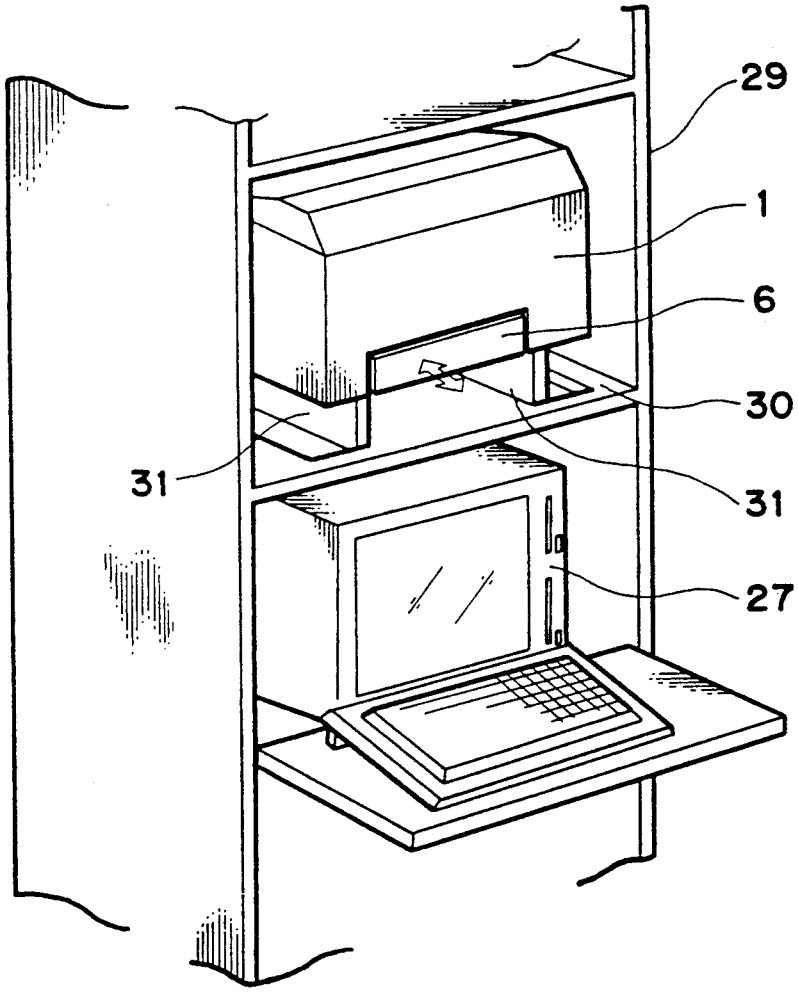
FIG. 5 is a perspective view showing another example of how the first embodiment is applied.

In FIG. 5, rockable seats 31 which can be cocked and laid are provided on a shelf 30 of a computer rack 29, and the printer 1 is installed on the cocked seats 31.

Figure 6:
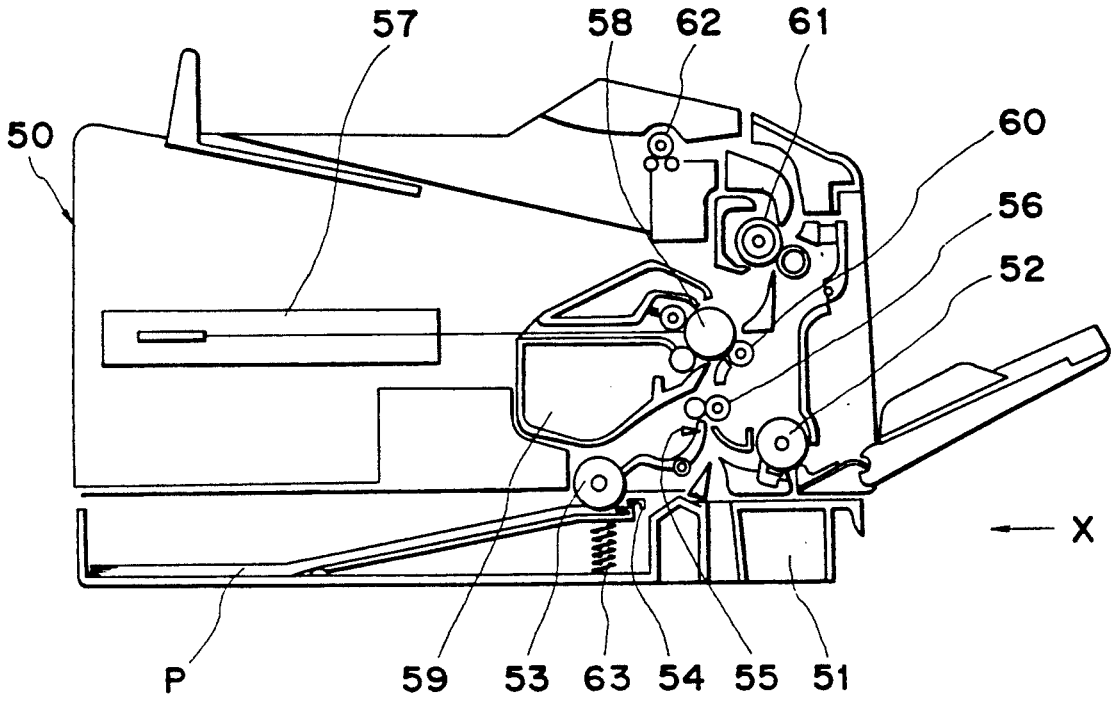
FIG. 6 is an elevational sectional view of an image forming system according to a third embodiment of the present invention.

FIG. 6 shows an image forming system 50 according to a third embodiment of the present invention, which includes a single cassette 51 having a sheet containing ability of 250 sheets, and a multi-manual sheet supply portion 52. Cut sheets P in the cassette 51 are fed out by a sheet supply roller 53 of the image forming system and are separated one by one by means of separating claws 54 formed on the cassette. When the cut sheet is fed out from the cassette, a leading end of the sheet turns ON an inlet sensor 55 in the system 50. The sheet supply roller 53 has rotated until a predetermined time period is elapsed after the sensor 55 was turned ON; meanwhile, a loop is surely formed in the sheet with the leading end of the sheet being abutted against regist rollers 56. In response to an image formation signal, a latent image is formed on a photosensitive drum 58 by scanning the drum with a laser beam from a laser scanner unit 57, and then the latent image is developed by a developing device 59 to form a toner image. At the same time, in response to the image formation signal, the regist rollers 56 are rotated so that the image is aligned with the cut sheet, with the result that the toner image on the drum 58 is transferred onto the cut sheet P by means of a transfer roller 60 (to which the bias is applied). Thereafter, the cut sheet is sent to a fixing device 61, where the toner image is permanently fixed to the sheet with high temperature (about 200° C). Then, the sheet is ejected out of the system by means of ejector rollers 62.

Figure 7:
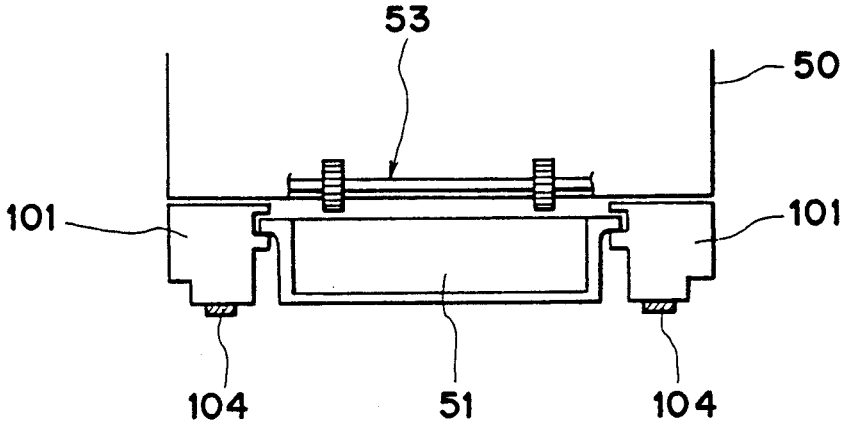
FIG. 7 is a view seen from a direction shown by the arrow X in FIG. 6.
Figure 8:
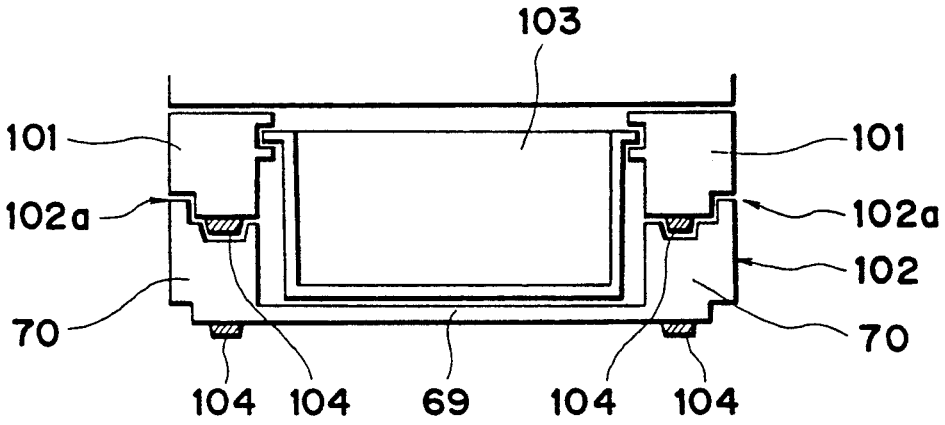
Figure 24A:
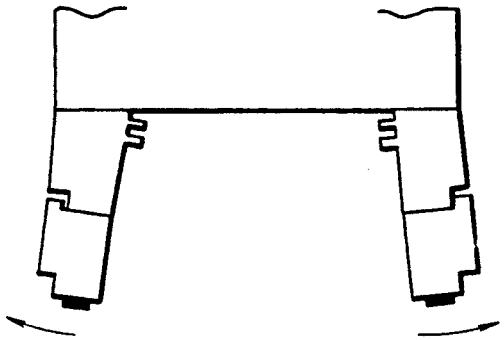
FIGS. 24A and 24B are schematic views for explaining inconvenience occurred when a base plate is omitted in the cassette extender according to the present invention.
Figure 24B:
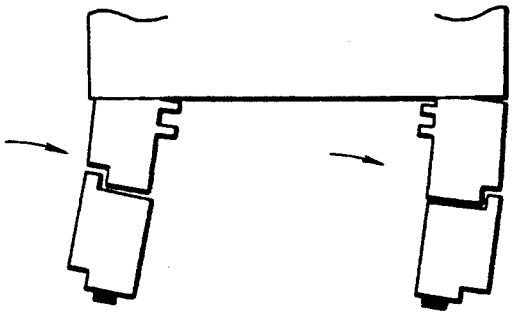

An uppermost sheet on the sheet stack contained in the cassette 51 is urged against the sheet supply roller 53 by springs 63. Since the cassette 51 is suspended from both side leg portions 101 of the image forming system, via hooks formed on both sides of the cassette, there is no member below the cassette, as shown in FIG. 7. Accordingly, as shown in FIG. 8, by using a cassette extender 102 for elevating the leg portions 101, it is possible to increase or expand a space of a cassette containing portion (for containing the cassette 51) opposite to the sheet supply means. Thus, a cassette 103 having the sheet containing ability of 500 sheets can be inserted into the sheet containing portion. As shown in FIG. 8, the cassette extender 102 comprises auxiliary legs 70 and a bottom plate 69 interconnecting the auxiliary legs at their bottoms. Thus, even when the height of the legs of the image forming system is increased, the rigidity of the system can be ensured, without distorting or bending the legs as shown in FIGS. 24A and 24B.

Figure 9:
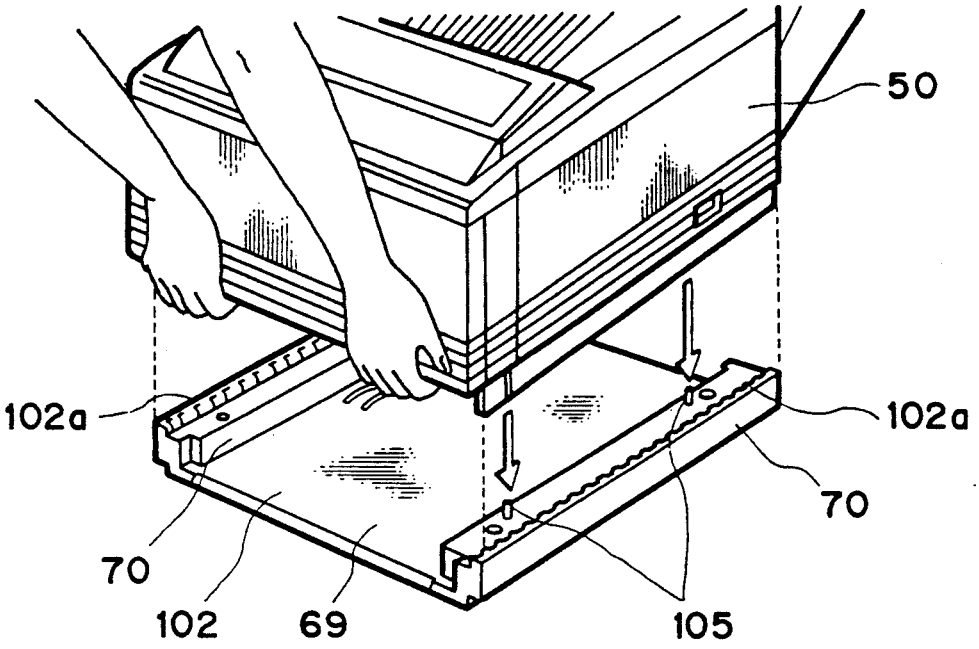
FIG. 9 is a perspective view showing how to mount the cassette extender.

Further, as shown in FIG. 9, the cassette extender 102 is positioned by pins 105 with respect to the image forming system 50 or a paper feeder as option which will be described later, so that the former is not displaced with respect to the latter. Furthermore, since the cassette extender has covering portions 102*a* for covering grip portions grasped by the operator for lifting the image forming system 50 and the optional paper feeder, when the image forming system is lifted, the existence of the cassette extender 102 can be ascertained, and, therefore, the situation that only the cassette extender is left unlifted can be avoided, thus preventing the cassette extender from being dropped and damaged.

Further, the cassette extender 102 does not interfere with rubber foots 104 of the image forming system and the optional paper feeder. The positioning between the extender and the system or the feeder is effected via the rigid surfaces thereof.

Figure 10:
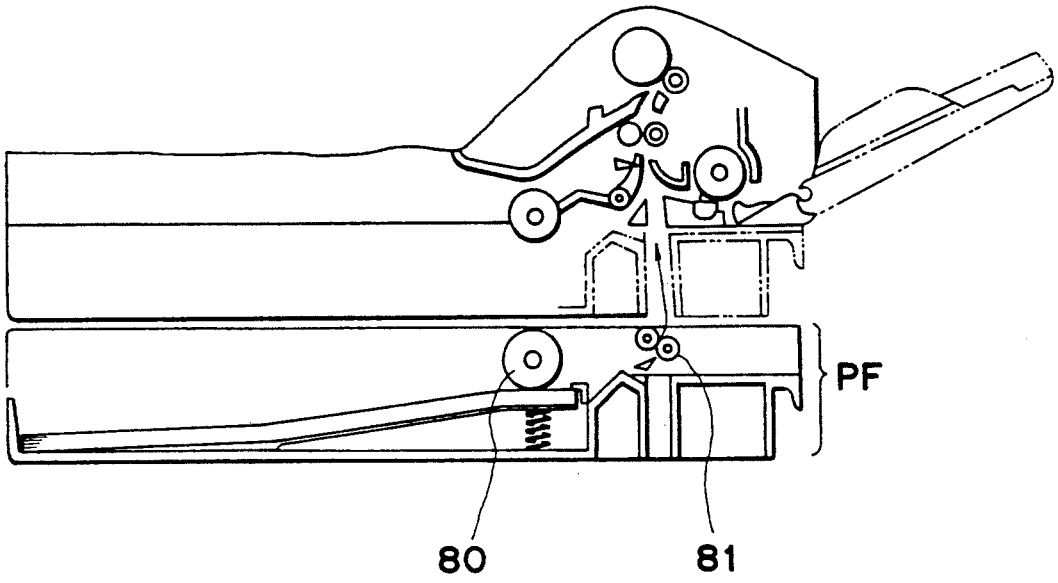
FIG. 10 is a partial elevational sectional view of the image forming system according to the third embodiment, on which a paper feeder is mounted as an option.
Figure 11:
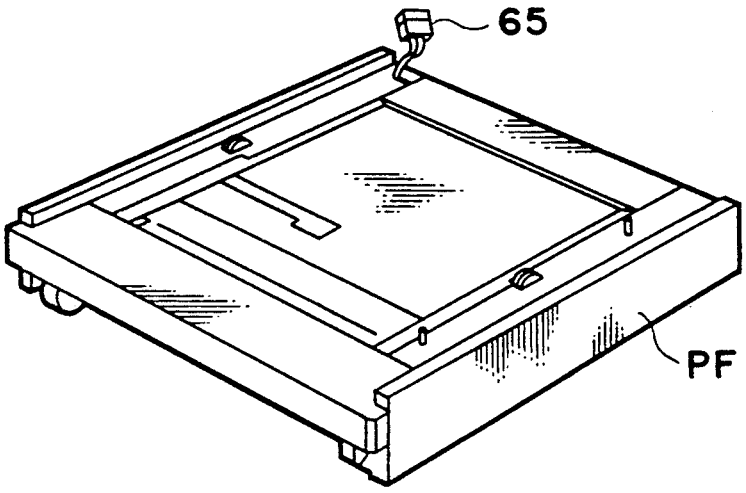
FIG. 11 is a perspective view of the paper feeder of FIG. 10.
Figure 12:
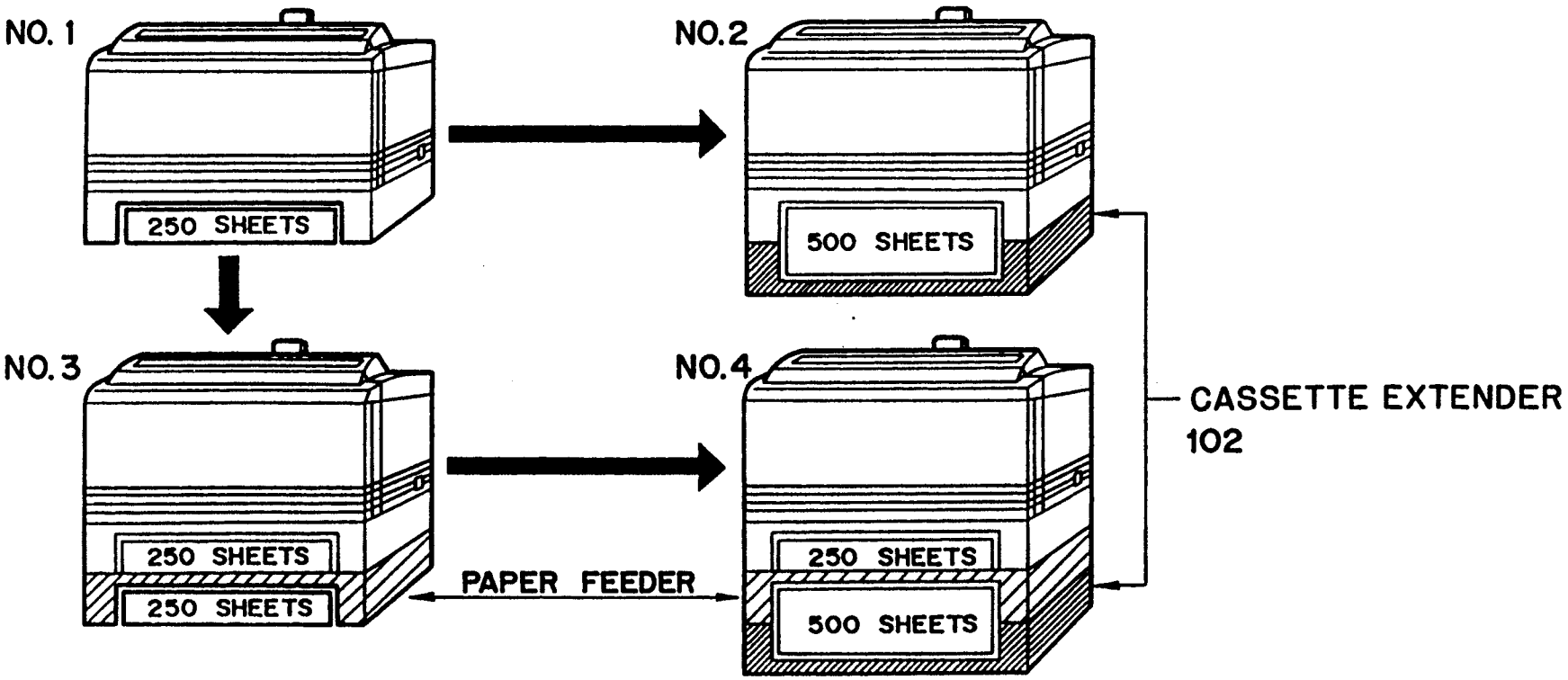
FIG. 12 are model views showing the combination of the cassette extender and the paper feeder.

Further, in association with the single cassette 51 having the sheet containing ability of 250 sheets, the image forming system is so designed that a paper feeder PF can be mounted within the system as an option. As shown in FIGS. 10 and 11, the paper feeder comprises a sheet supply roller 80 and intermediate feed rollers 81 which are rotatingly controlled by a motor and a clutch (not shown) provided in the paper feeder PF, and communicated with the image forming system 50 via a cable 65 for signal communication. A cut sheet fed from the optional paper feeder by the sheet supply roller 80 and intermediate feed rollers 81 passes through a passage formed in the upper single cassette 51 to reach the regist rollers 56, and is used for the image formation in the same manner as the cut sheet from the cassette 51. Similar to the upper cassette 51 having the sheet containing ability of 250 sheets, the optional paper feeder PF is also designed so that the identical cassette extender 102 can be mounted on the feeder. That is, a space of a sheet containing portion for the optional paper feeder can be expanded from a size capable of containing a cassette having the sheet containing ability of 250 sheets, to a size capable of containing a cassette having the sheet containing ability of 500 sheets. FIG. 12 shows a model illustrating the expansion of the sheet containing portion. In this way, if only the sheets of the same size are used, the sheet containing ability can be increased from 250 sheets to 500 sheets by merely using the relatively cheap cassette extender without requiring any paper feeder. Further, the operator can freely select the sheet containing ability from the standard 250 sheets to the maximum 750 sheets (triple), and he can buy the optional paper feeder at any time on demand.

Further, as in this embodiment, since the cassette containing space can be increased in a downward direction within the same installation space, the installation space for the image forming system does not increase. Furthermore, as the cassette containing space increased, by using a pedestal having a lower height, the total height of the system can be adjusted.

Figure 13:
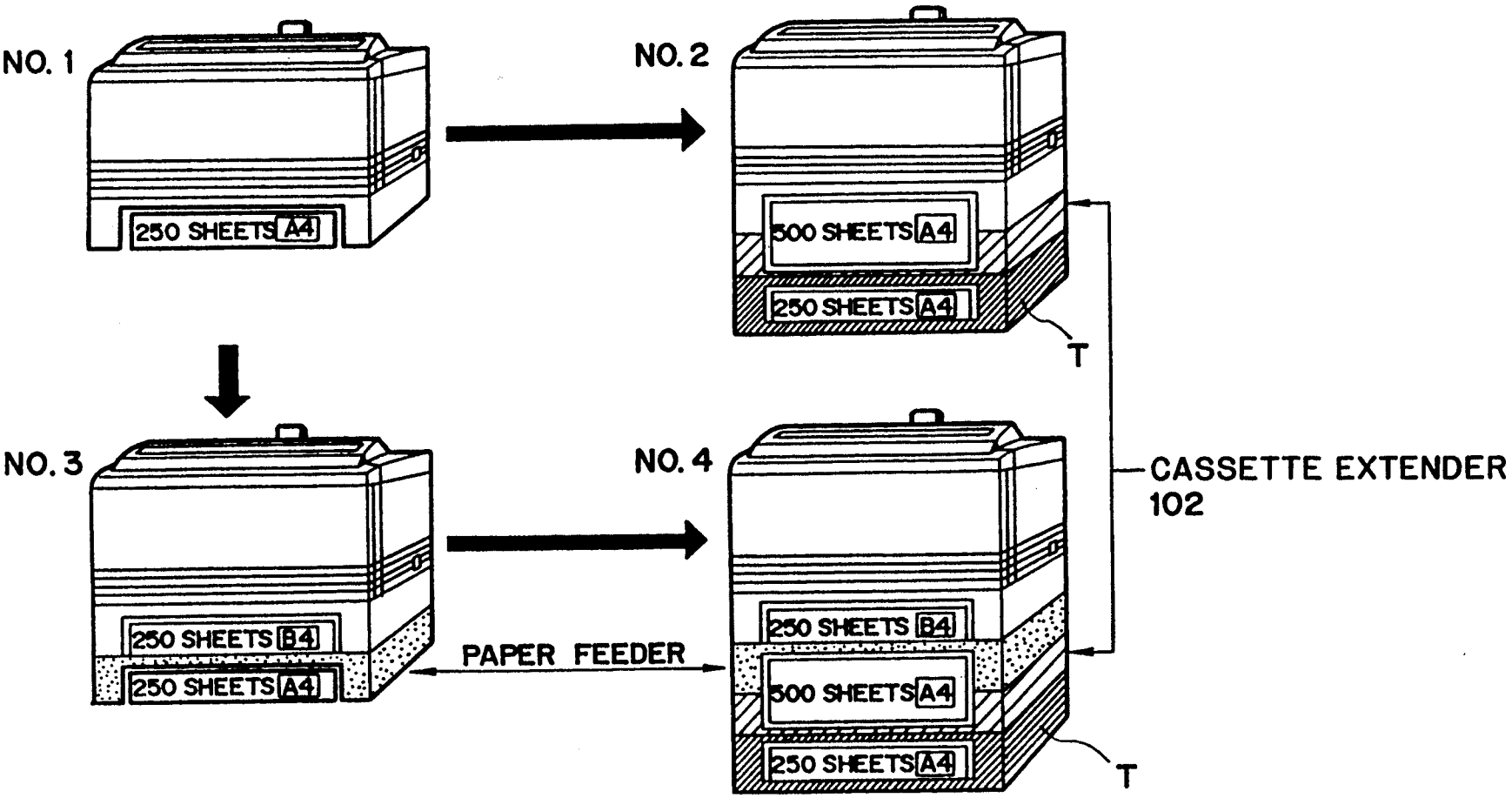
FIG. 13 are model views showing the combination of the cassette extender, the paper feeder and a cassette containing tray.
Figure 14:
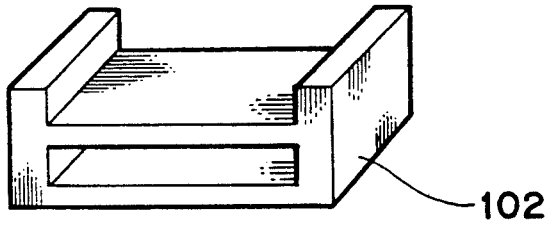
FIGS. 14 and 15 are perspective views of the cassette containing tray.
Figure 15:
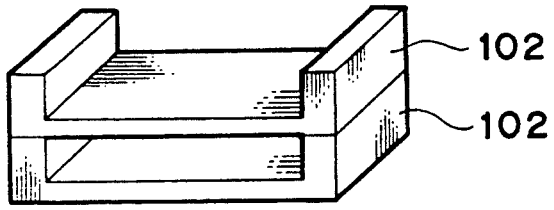

As an alteration, as shown in FIG. 13, a cassette containing tray portion T may be added under the cassette extender 102. In this case, when the sheet containing ability is changed from the standard 250 sheets (No. 1) to 500 sheets (No. 2), or is changed from 500 sheets (No. 3) to 750 sheets (No. 4), the remaining 250 sheet cassette can be housed in the tray portion T. Therefore, space for storing the remaining cassette is not required space. Further, in place of the cassette containing tray portion, a two-stage cassette extender as shown in FIG. 14 may be used, or two cassette extenders may be overlapped or stacked as shown in FIG. 15.

As mentioned above, since the same extender means (cassette extender) for expanding the cut sheet containing portion can be mounted on both the image forming system and the optional paper feeder, the operator can select the sheet containing ability within the broader range, whereby the operator can obtain the optimum system in consideration of the cost and circumstances. In addition, it is possible to increase the cut sheet containing ability without changing the installation space for the image forming system.

Figure 16:
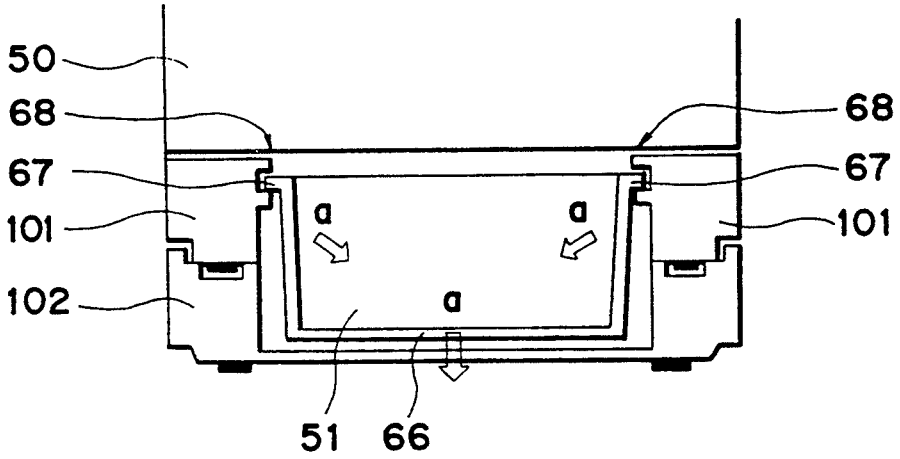
FIG. 16 is a view showing an alteration of the cassette.

Now, when the cassette 103 having the sheet containing ability of 500 sheets is mounted, as shown in FIG. 16, and if the cassette includes substantially full sheets (500 sheets) therein, it is feared that the cassette itself could be flexed or deformed in directions shown by the arrows a because of the total weight of the sheets and because a distance between a cassette bottom 66 receiving the total weight of the sheets and supporting points 67 for supporting the cassette is long. Such flexion or deformation noticeably appears particularly at a side opposite to a side where the sheet supply means is disposed, because such side is not reinforced at all and the sheet supply side is reinforced by various elements for supplying the sheet.

Due to such flexion or deformation of the cassette, it was feared that the sliding resistence between the cassette and the auxiliary legs could be increased, thus making the mounting and dismounting of the cassette difficult and causing the poor sheet supply and/or the poor image position on the sheet.

Means for eliminating these drawbacks without fail will be described hereinbelow.

Figure 17:
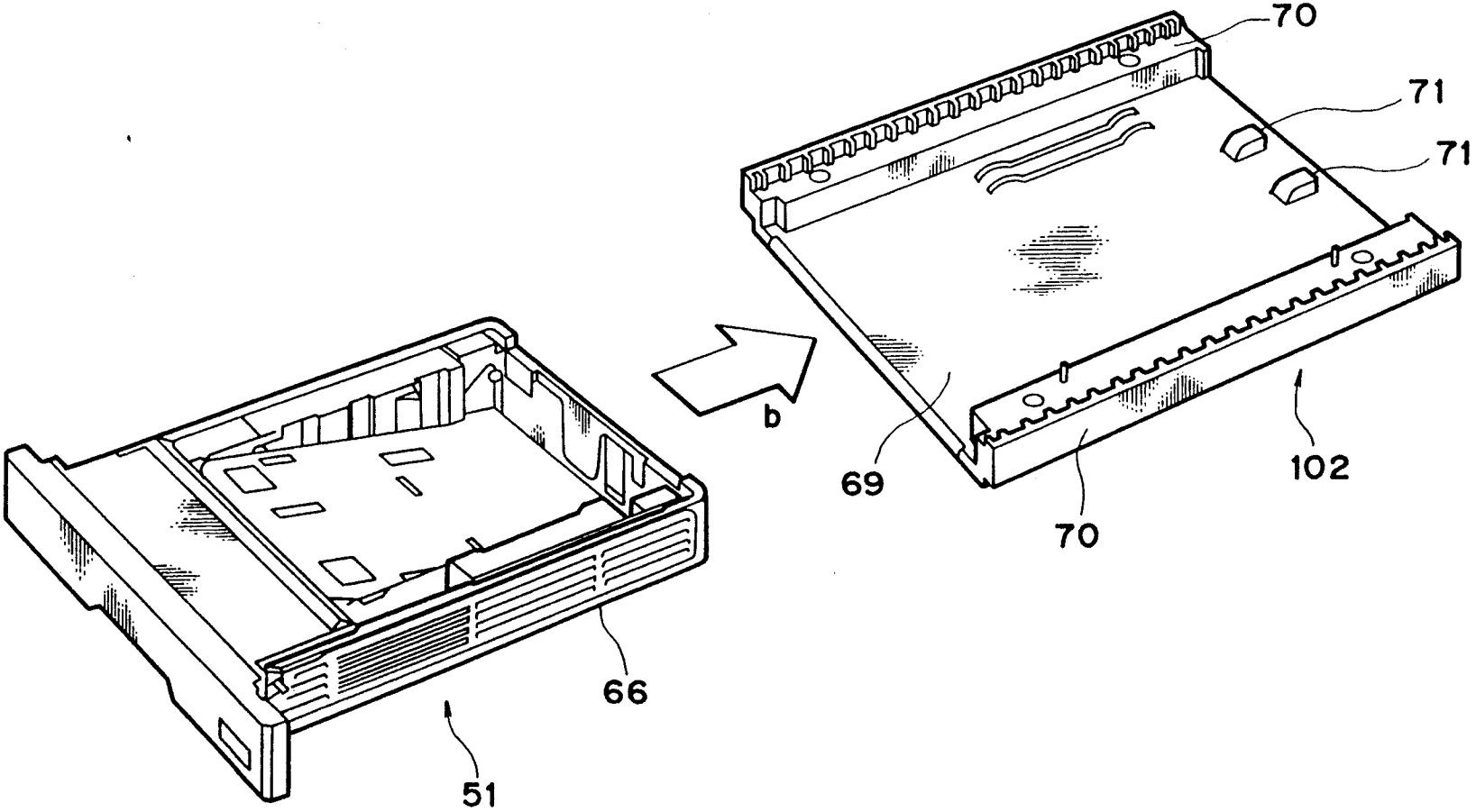
FIG. 17 is a perspective view showing an example of a cassette extender having projections for catching the cassette.
Figure 18:
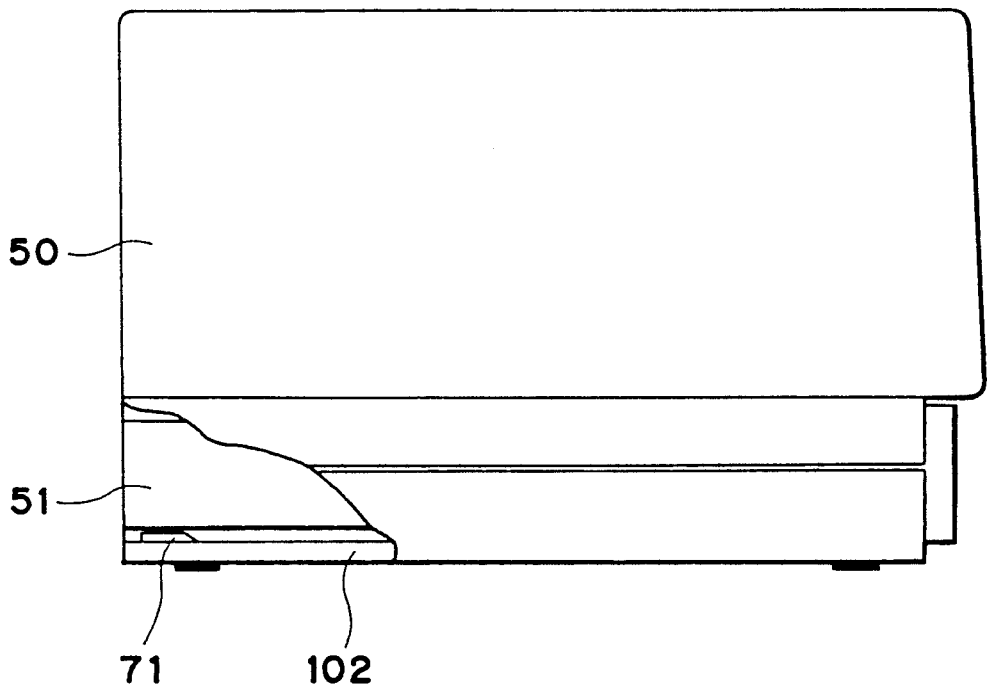
FIG. 18 is a side view, in partial section, of an image forming system on which the cassette extender of FIG. 17 is mounted.

In FIG. 17, the cassette extender 102 for mounting a cassette having the sheet containing ability of 500 sheets comprises a bottom plate 69, auxiliary legs 70 on which the image forming system 50 is rested, and the like. Two ribs 71 are formed on the bottom plate 69. The 500 sheet containable cassette 103 comprises a bottom and a sheet supply means (both not shown) as in the conventional one. The 500 sheet containable cassette is inserted along a direction shown by the arrow b, and the ribs 71 are positioned so that when the 500 sheet containable cassette is completely mounted within the cassette extender, the ribs are engaged by the bottom 66 of the cassette at a side opposite to the sheet supplying side, as shown in FIG. 18. As shown, the ribs 71 have smooth surfaces at the cassette insertion side so that the cassette 103 can be smoothly mounted even if the cassette is deformed. With this arrangement, it is possible to prevent the deformation of the 500 sheet cassette even when the full 500 sheets are loaded in the cassette.

Figure 19:
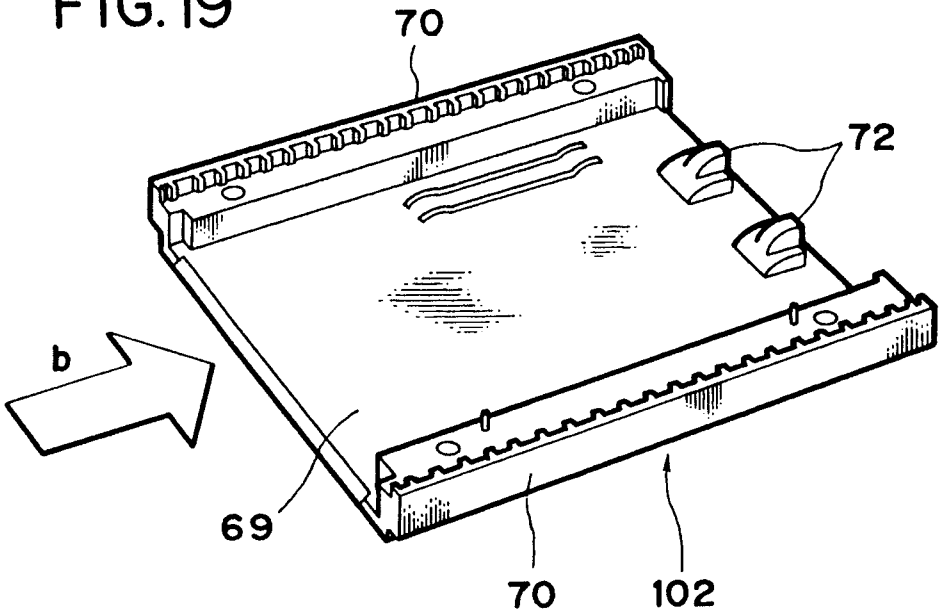
FIG. 19 is a perspective view showing another example of a cassette extender having projections for catching the cassette.
Figure 20:
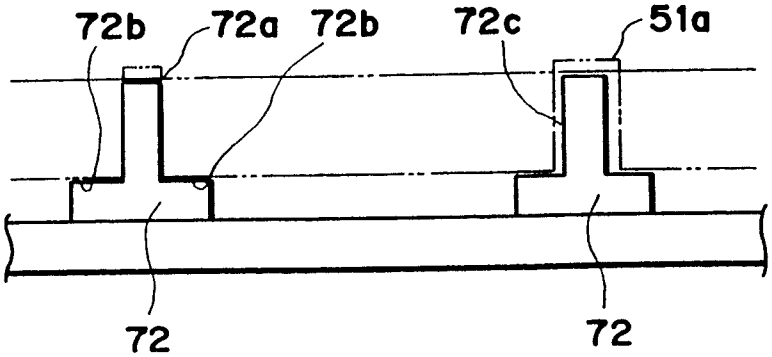
FIG. 20 is a view showing a mounting relation between the projections of FIG. 19 and cassettes having different sheet containing abilities.
Figure 21:
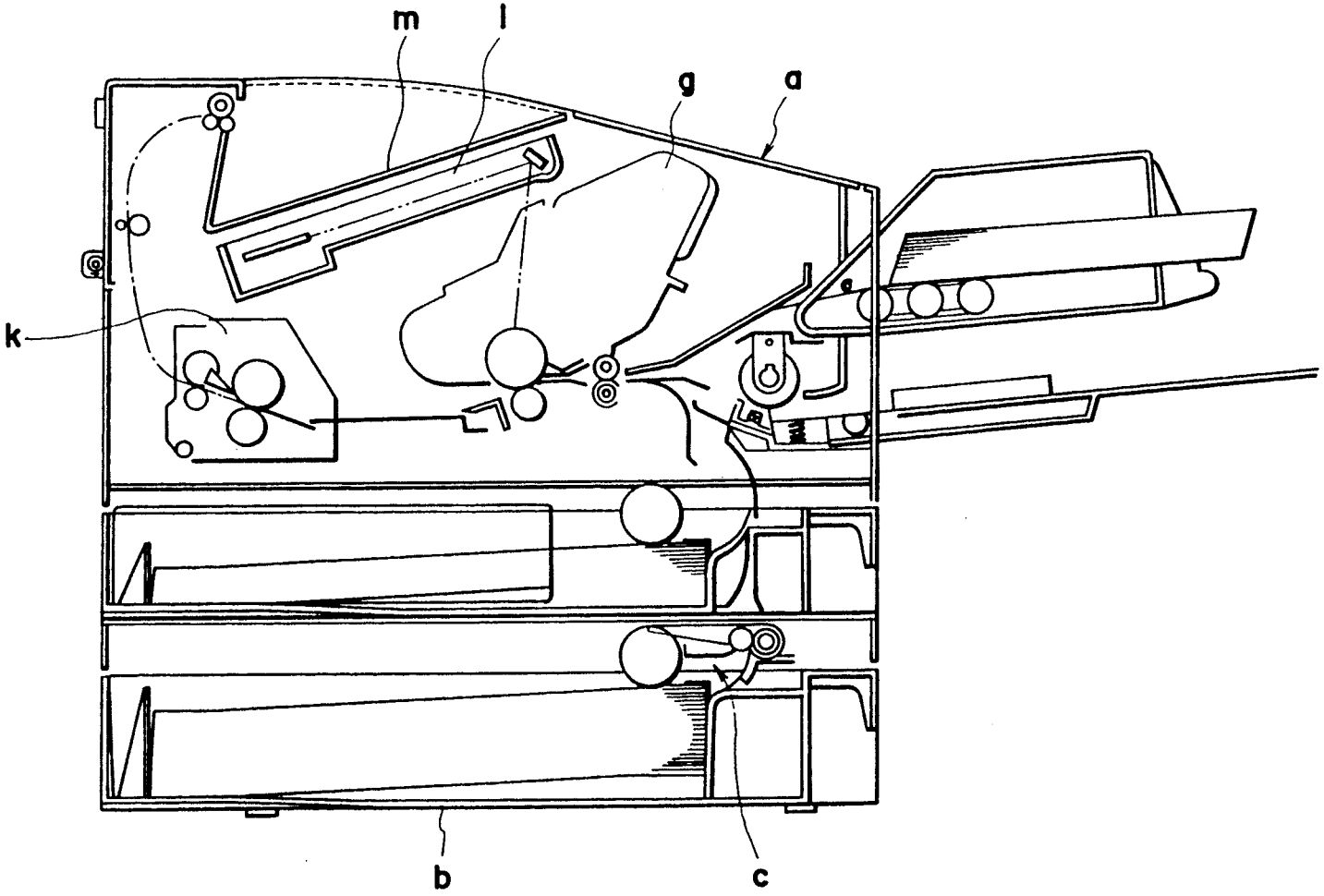
FIG. 21 PRIOR ART
FIG. 21 is an elevational sectional view of a conventional recording apparatus.

FIGS. 19 and 20 show a further embodiment of the present invention, where FIG. 19 is a perspective view showing a cassette extender in detail, and FIG. 20 is a view showing ribs for supporting the greater sheet containable cassette in detail. In an image forming system according to this embodiment, it is possible to mount one of plural kinds of cassettes having different sheet containing abilities on the image forming system, by attaching a single cassette extender to the system. That is to say, in this embodiment, by attaching a cassette extender 102 to an image forming system which can receive a cassette having the sheet containing ability of 250 sheets as in the previous example, not only can a cassette having the sheet containing ability of 500 sheets, be mounted on the image forming system, but also, one having the sheet containing ability of 700 sheets.

In FIG. 19, the cassette extender 102 for permitting the mounting of the greater sheet containable cassettes comprises a bottom plate 69 and auxiliary legs 70 on which the image forming system is rested, as in the previous example. Two ribs 72 are formed on the bottom plate 69. Incidentally, the cassette is inserted from a direction shown by the arrow b. Each rib 72 has an inverted T-shaped cross-section. As shown in FIG. 20, when the cassette having the sheet containing ability of 500 sheets is mounted on the image forming system, the bottom 66 of the cassette is engaged by rib surfaces **72*a* of the ribs 72; whereas, when the cassette having the sheet containing ability of 700 sheets is mounted on the image forming system, the bottom 66 of the cassette is engaged by rib surfaces 72*b* of the ribs 72. When the cassette bottom is engaged by the rib surfaces 72*b*, since the contacting area between the cassette and the ribs is increased in comparison with the contacting area between the cassette and the rib surfaces 72*a*, the heavier 700 sheet cassette can be stably supported. Incidentally, the cassette bottom is engaged by the rib surfaces 72*a* or 72*b* at the side opposite to the sheet supplying side. The bottom of the 500 sheet cassette has two recesses 51*a* so that this cassette does not interfere with projections 72*c* of the ribs, as shown in FIG. 20. Further, one of the recesses 51*a* has a width substantially the same as that of the rib projection 72c so that the cassette can be positioned with respect to the cassette extender in the left and right direction of the cassette. Further, the recesses 51a and the rib projections 72c** are complementarily tapered so as to facilitate the mounting of the cassette on the cassette extender.

Further, the ribs 72 have smoothly inclined surfaces at the cassette insertion side so that the cassette 103 can be smoothly mounted even if the cassette is deformed, as in the previous case. With this arrangement, it is possible to prevent the deformation of not only the 500 sheet cassette, but also the 700 sheet cassette even when the full sheets are loaded in the cassettes.

As mentioned above, by providing the ribs for supporting the cassette bottom(s) on the cassette extender, it is possible to prevent the deformation of the greater sheet containable cassette(s) even when the full sheets are loaded in the cassette(s). Thus, to prevent the resistance in the cassette insertion force, the poor sheet supply, and the discrepancy in position between the sheet and the image transferred onto the sheet.

What is claimed is:

1. A sheet feeding apparatus comprising:

a containing portion capable of containing a first sheet supporting means for stacking and supporting sheets;

extender means for expanding a containing space of said containing portion in a height direction so that a second sheet supporting means having sheet containing ability greater than that of said first sheet supporting means can be contained in the expanded containing space; and sheet supply means for feeding out the sheet from said first or second sheet supporting means contained in said containing portion;

wherein said extender means includes a plurality of extender members adapted to be arranged at both lateral sides of said sheet supporting means to increase the height of said containing portion, and connecting means for connecting said plurality of extender members.

2. A sheet feeding apparatus according to claim 1, wherein said containing portion has a guide means for supporting said first sheet supporting means for movement toward and away from said containing space.

3. A sheet feeding apparatus according to claim 2, wherein said guide means supports said second sheet supporting means for movement toward and away from said containing space, when said containing space of said containing portion is expanded by said extender means.

4. A sheet feeding apparatus according to claim 1, wherein said expander means is removably mounted on said containing portion.

5. A sheet feeding apparatus according to claim 4, further including positioning means for positioning said extender means and said containing portion with respect to each other at the time when said expander means is mounted on said containing portion.

6. A sheet feeding apparatus according to claim 1, wherein said expander means is foldably connected to said expander means.

7. A sheet feeding apparatus according to claim 6, wherein said expander means includes a plurality of foldable extender members including a plurality of support legs pivotable with respect to said containing portion and horizontal bars interconnecting said support legs, and connecting means for interconnecting said expander members.

8. A sheet feeding apparatus according to claim 1, wherein said expander members of said expander means is auxiliary leg members adapted to be arranged below said containing portion and at both lateral sides of said sheet supporting means to increase the height of said containing space of said containing portion, and said connecting means is a bottom plate for interconnecting said auxiliary leg members.

9. A sheet feeding apparatus according to claim 8, wherein said bottom plate is provided with projections for supporting said second sheet supporting means from below.

10. A sheet feeding apparatus according to claim 9, wherein said projections support said second sheet supporting means at a side thereof opposite to a side where the sheet is fed from said second sheet supporting means by said sheet supply means.

11. An image forming system comprising:

a containing portion capable of containing a first sheet supporting means for stacking and supporting sheets;

extender means for expanding a containing space of said containing portion in a height direction so that a second sheet supporting means having sheet containing ability greater than that of said first sheet supporting means can be contained in the expanded containing space;

sheet supply means for feeding out the sheet from said first or second sheet supporting means contained in said containing portion; and image forming means for forming an image on the sheet fed by said sheet supply means;

wherein said extender means includes a plurality of extender members adapted to be arranged at both lateral sides of said sheet supporting means to increase the height of said containing portion, and connecting means for connecting said plurality of extender members.

12. An image forming system according to claim 11, further including a pair of leg portions disposed below said image forming system, and said containing portion is arranged between said leg portions to contain said first sheet supporting means therein.

13. An image forming system according to claim 12, wherein said expander means is removably mounted on said containing portion below the latter.

14. An image forming system according to claim 13, wherein said expander members of said expander means is auxiliary leg members adapted to be removably connected to said leg portions, and said connecting means is a bottom plate for interconnecting said auxiliary leg members.

15. An image forming system according to claim 14, wherein said bottom plate is provided with projections for supporting said second sheet supporting means from below.

16. An image forming system according to claim 15, wherein said projections support said second sheet supporting means at a side thereof opposite to a side where the sheet is fed from said second sheet supporting means by said sheet supply means.

17. An image forming system according to claim 15, wherein said projections have two-step surfaces, whereby first-step surfaces adapt to support said second sheet supporting means and second-step surfaces adapt to support a third sheet supporting means having sheet containing ability greater than that of said second sheet supporting means.

18. An image forming system according to claim 11, wherein said expander means has a contour so that an area of said image forming system projected on a horizontal plane becomes substantially the same as that of said extender means projected on the horizontal plane.

19. An image forming system according to claim 11, further including a sheet supply unit adapted to be removably mounted on said containing portion below the latter.

20. An image forming system according to claim 19, wherein said sheet supply unit has an auxiliary containing portion for containing a fourth sheet supporting means so that a sheet can be fed from said fourth sheet supporting means to said image forming system.

21. An image forming system according to claim 20, wherein said expander means can be connected to said sheet supply unit at a lower portion of the latter, and when said expander means is connected to said sheet supply unit, said auxiliary containing portion can be expanded in a height direction to contain therein a fifth sheet supporting means having the sheet containing ability greater than that of said fourth sheet supporting means.

* * * * *

UNITED STATES PATENT AND TRADEMARK OFFICE

CERTIFICATE OF CORRECTION

PATENT NO. 5,191,382

DATED March 2, 1993

INVENTOR(S): SHIGERU OKAMURA, ET AL.

It is certified that error appears in the above-indentified patent and that said Letters Patent is hereby corrected as shown below:

COLUMN 1

Figure 22:
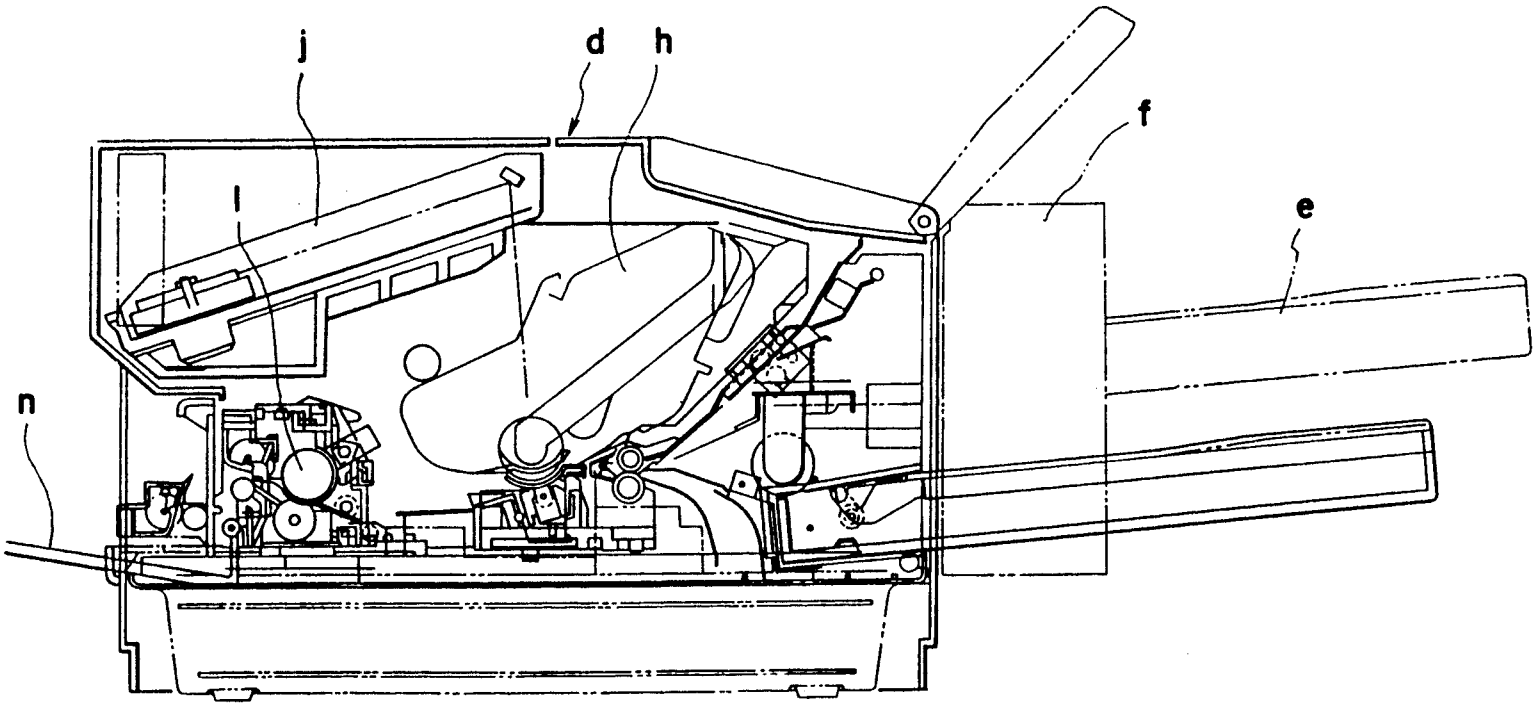
FIG. 22 PRIOR ART
FIG. 22 is an elevational sectional view of another conventional recording apparatus.
Figure 23A:
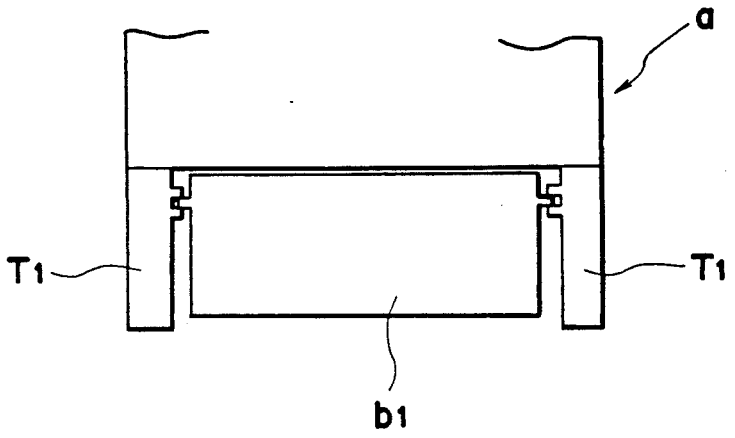
FIG. 23A PRIOR ART
FIGS. 23A and 23B are schematic views showing conventional leg members.
Figure 23B:
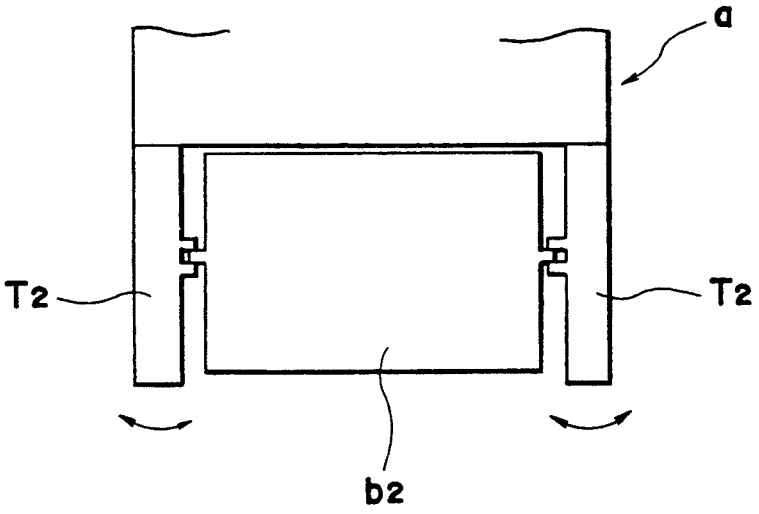
FIG. 23B PRIOR ART

Line 35, "FIGS. 22" should read --(FIG. 22),--.

COLUMN 2

Line 1, "s" should read --supply--.

Line 34, "extender" should read --an extender--.

COLUMN 4

Line 17, "an" should read --a--.

COLUMN 5

Line 26, "and," should read --and--.

COLUMN 6

Line 4, "has" should read --is--; and "is" should read --has--.

Line 55, "rubber foots 104" should read --rubber feet 104--.

UNITED STATES PATENT AND TRADEMARK OFFICE

CERTIFICATE OF CORRECTION

PATENT NO. 5,191,382

DATED March 2, 1993

INVENTOR(S) SHIGERU OKAMURA, ET AL.

It is certified that error appears in the above-indentified patent and that said Letters Patent is hereby corrected as shown below:

COLUMN 7

Line 68, "resistence" should read --resistance--.

COLUMN 10

Line 5, "is" should read --are--.

Line 51, "is" should read --are--.

Signed and Sealed this

Twenty-fifth Day of January, 1994

Bruce Lehman

*Attest:*

BRUCE LEHMAN

*Attesting Officer*

*Commissioner of Patents and Trademarks*